United States Patent [19]

Blanc et al.

[11] Patent Number: 4,528,910

[45] Date of Patent: Jul. 16, 1985

[54] APPARATUS FOR CUTTING A SUBMERGED TUBE BY MEANS OF A PYROTECHNIC CHARGE

[75] Inventors: Jean-Paul Blanc, Saone; Claude Fardouet, Massy; Alain Freslon, Veignee, all of France

[73] Assignee: Commissariat a l'Energie Atomique, Paris, France

[21] Appl. No.: 541,516

[22] Filed: Oct. 13, 1983

[30] Foreign Application Priority Data

Oct. 15, 1982 [FR] France ..... 82 17276

[51] Int. Cl.[3] ..... F42B 1/02

[52] U.S. Cl. ..... 102/306; 102/312; 102/319; 102/307; 166/63; 166/361

[58] Field of Search ..... 102/306, 307, 312, 313, 102/319; 166/361, 63; 299/13

[56] References Cited

U.S. PATENT DOCUMENTS

| | | | |
|---|---|---|---|
| 2,679,899 | 6/1954 | Osborn | 102/313 X |
| 2,737,115 | 3/1956 | Bissell | 102/20 |
| 2,749,840 | 6/1956 | Babcock | 102/319 X |
| 2,919,111 | 12/1959 | Nicolson | 166/361 X |
| 2,980,017 | 4/1961 | Castel | 102/313 X |
| 3,031,964 | 1/1962 | Chestnut | 102/21 |
| 3,058,522 | 10/1962 | McElheny | 102/319 X |
| 3,195,631 | 1/1965 | Smith | 166/35 |
| 3,338,305 | 8/1967 | Pittman et al. | 166/361 X |
| 3,870,098 | 3/1975 | Houston | 166/361 X |
| 4,063,509 | 12/1977 | Leonard et al. | 102/20 |
| 4,116,130 | 9/1978 | Christopher et al. | 102/20 |
| 4,181,196 | 1/1980 | Darby et al. | 166/361 |

FOREIGN PATENT DOCUMENTS 900201 12/1953 Fed. Rep. of Germany .

*Primary Examiner*—Peter A. Nelson

[57] ABSTRACT

Apparatus for the pyrotechnic cutting of a submerged tube.

The apparatus, which is introduced into the tube, comprises in a conventional manner a chassis on which is mounted a support for a pyrotechnic charge, a shield in the upper part of the chassis and a compressed air intake for producing an air pocket below the shield. According to the invention, the apparatus also comprises a ballast for facilitating its lowering to a considerable depth and the charge is a detonating cord with a hollow charge extending continuously over the support, the clearance between the charge and the inner wall of the tube being of minimum size and the same throughout.

12 Claims, 6 Drawing Figures

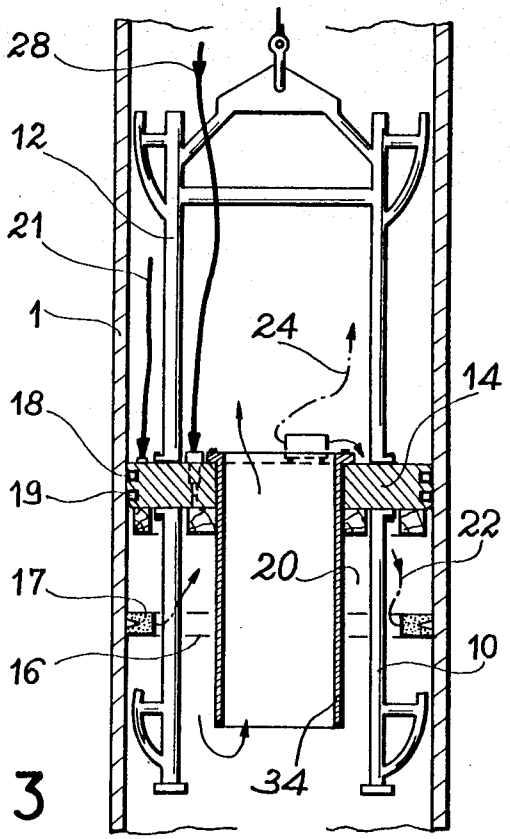
FIG. 3
FIG. 2
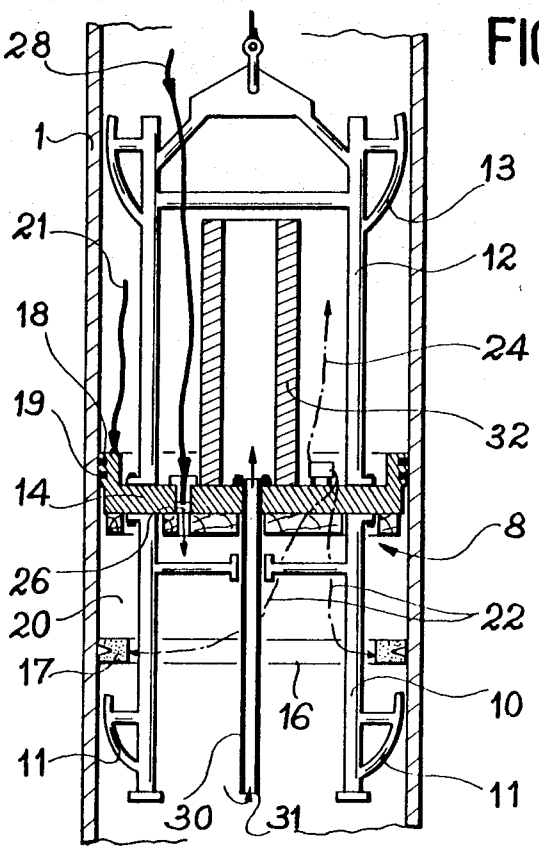

APPARATUS FOR CUTTING A SUBMERGED TUBE BY MEANS OF A PYROTECHNIC CHARGE

BACKGROUND OF THE INVENTION

The present invention relates to an apparatus for cutting submerged metal tubes and more particularly large diameter, high thickness tubes by means of a pyrotechnic charge.

When offshore installations, such as the metal tubes of wildcat wells require, after sinking, the partial or total elimination of their submerged parts, the cutting thereof can be carried out pyrotechnically. Generally, this cutting takes place at a point which is under water and which is as close as possible to the sea bed. The cut tube portion is then removed.

At present, numerous means exist, which make it possible either to perforate, or cut a submerged tube. For this purpose, a pyrotechnic charge, mounted on a support, is lowered within the tube to the desired depth and an air pocket is formed at the level of the charge in order that the explosion takes place in air and not in water. Thus, normally, use is made of hollow charges and the efficiency of such a charge is better in air than in water.

However, the presently used means can only be used as limited depths and do not make it possible to cut large diameter, high thickness tubes. Moreover, they generally only permit a partial cutting of the tube whereas, in certain cases and in particular for dismantling offshore installations, it is necessary to obtain a complete cut in a cross-section of the tube.

SUMMARY OF THE INVENTION

The present invention aims at eliminating these disadvantages by means of an apparatus for the pyrotechnic cutting of a submerged tube, which makes it possible to operate at considerable depths (i.e. depths exceeding 40 meters) and to cut large diameter, high thickness tubes, e.g. a diameter of 2 mm and a thickness of 30 mm. In addition, the apparatus according to the invention ensures a complete cutting of the tube.

According to the main feature of the apparatus according to the invention, the latter, of the type comprising at least one chassis having an upper end and a lower end, a support for the pyrotechnic charge mounted on the chassis, a shield mounted on the upper end of the chassis, means for forming the seal between the shield and the inner wall of the tube, means for forming an air pocket below the shield when the apparatus is placed within the tube and means for checking the height of the air pocket, wherein it also comprises a member having a considerable weight serving as ballast and wherein the pyrotechnic charge is a detonating cord with a hollow charge placed in a continuous manner on its support, the shape and dimensions of the cord and the support being such that the clearance between the cord and the inner wall of the tube is of a minimum nature and is the same at any point on the cord.

In most cases, the tube to be cut is vertical and the cutting is carried out in a cross-section of the tube.

The ballast can be in several forms, e.g. a high thickness tubular member placed above the shield, a cylindrical skirt placed below the shield or a solid cylindrical member which is also placed below the shield.

According to a preferred embodiment, the means for checking the height of the air pocket comprise a tube extending vertically below the shield over a height equal to that of the air pocket and connected to the surface by a control tube.

According to another feature of the apparatus according to the ivention, the chassis comprises at least one foot having an upper end and a lower end, its upper end being fixed to the shield, whilst the foot is a hollow cylindrical tube serving as a means for controlling the height of the air pocket.

Finally, according to a last characteristic of the apparatus according to the invention, the chassis has at least one foot with an upper end and a lower end, its upper end being fixed to the shield, whilst is also incorporates at least one guidance abutment or stop mounted on a cylindrical sleeve, which is itself pivotably fitted to the lower end of the foot.

BRIEF DESCRIPTION OF THE DRAWINGS

The invention is described in greater detail hereinafter relative to non-limitative embodiments of the invention and with reference to the attacked drawings, wherein show:

FIG. 2 a diagrammatic vertical sectional view of the first version of the apparatus according to the invention placed within the tube to be cut.

FIG. 3 a view similar to FIG. 2 illustrating a second version of this apparatus.

DETAILED DESCRIPTION OF THE INVENTION

Figure 1:
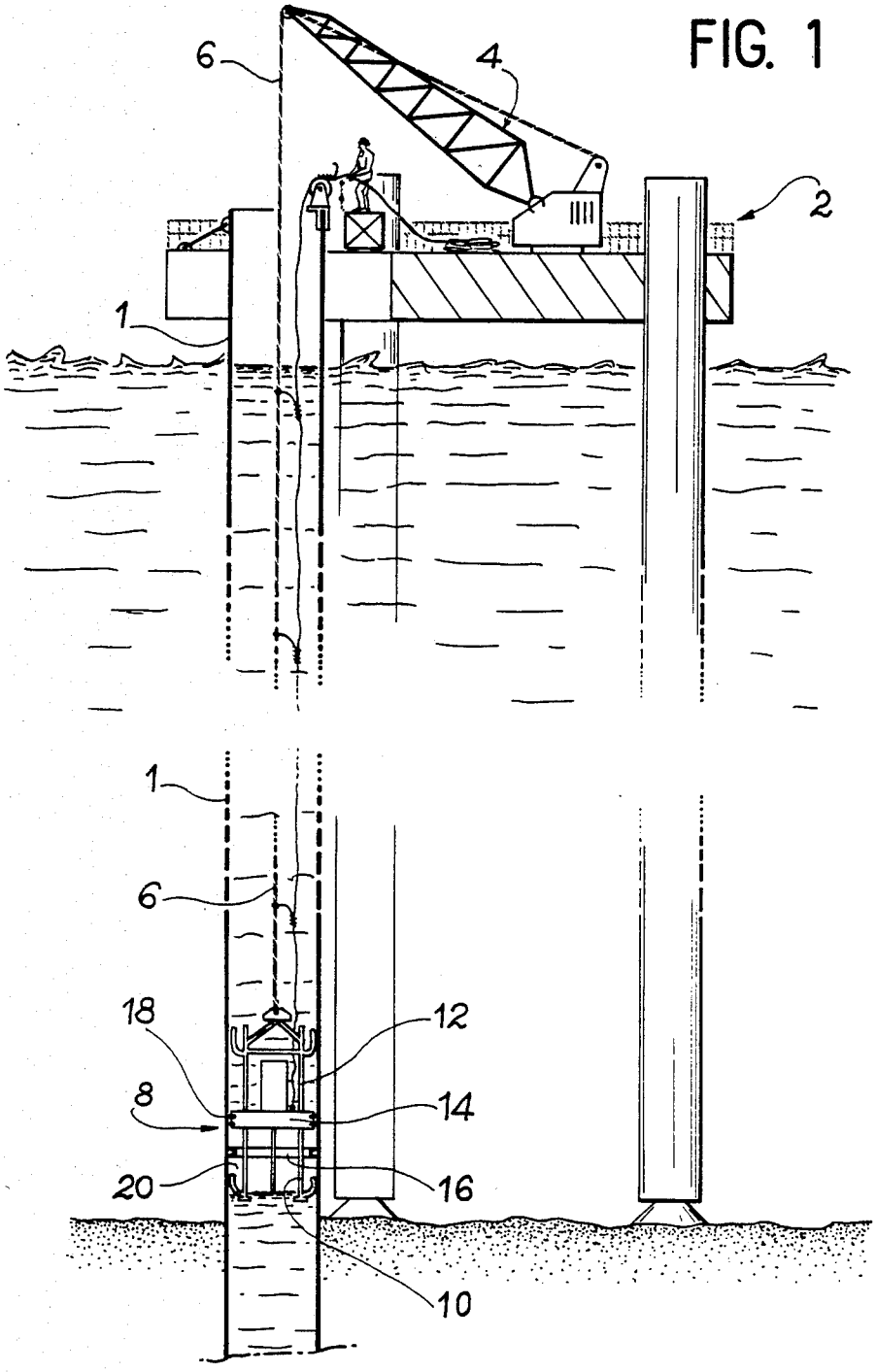
FIG. 1 a diagrammatic vertical sectional view illustrating the introduction of the apparatus according to the invention into a tube to be cut.

FIG. 1 shows the submerged tube to be cut 1, whilst a platform 2 has been installed in its vicinity with a view to carrying out this operation. A crane 4 mounted on the platform makes it possible, with the aid of a cable or chain 6, to lower the apparatus according to the invention 8 into the tube. As can be seen in the drawing, cutting is carried out as close as possible to the bottom. It is also possible to see that the apparatus or tube-cutter according to the invention essentially comprises a lower chassis 10 and an upper chassis 12, separated by a shield 14, whilst the pyrotechnic charge is mounted on a support 16, which is itself fixed to the lower chassis 10. The pyrotechnic charge is constituted by a detonating cord having a hollow charge, whose length is substantially equal to the circumference of the tube whilst support 16 is circular. This leads to a considerable operating reliability, because the clearance between the detonating cord and the inner wall of the tube is extremely small and remains virtually the same throughout, not exceeding a few millimeters. Shield 14 is roughly in the form of a solid disk, whose external diameter is roughly equal to the internal diameter of the tube and it is equipped with inflatable joints making it possible to ensure the seal between said shield and the inner wall of the tube. There are generally two joints 18, 19, as can be gathered from FIGS. 2 to 4. As a result of this arrangement, it is possible to produce a compressed air pocket 20 below shield 14, in order that the pyrotechnic charge is in air and not in water at the time of the explosion.

Figure 4:
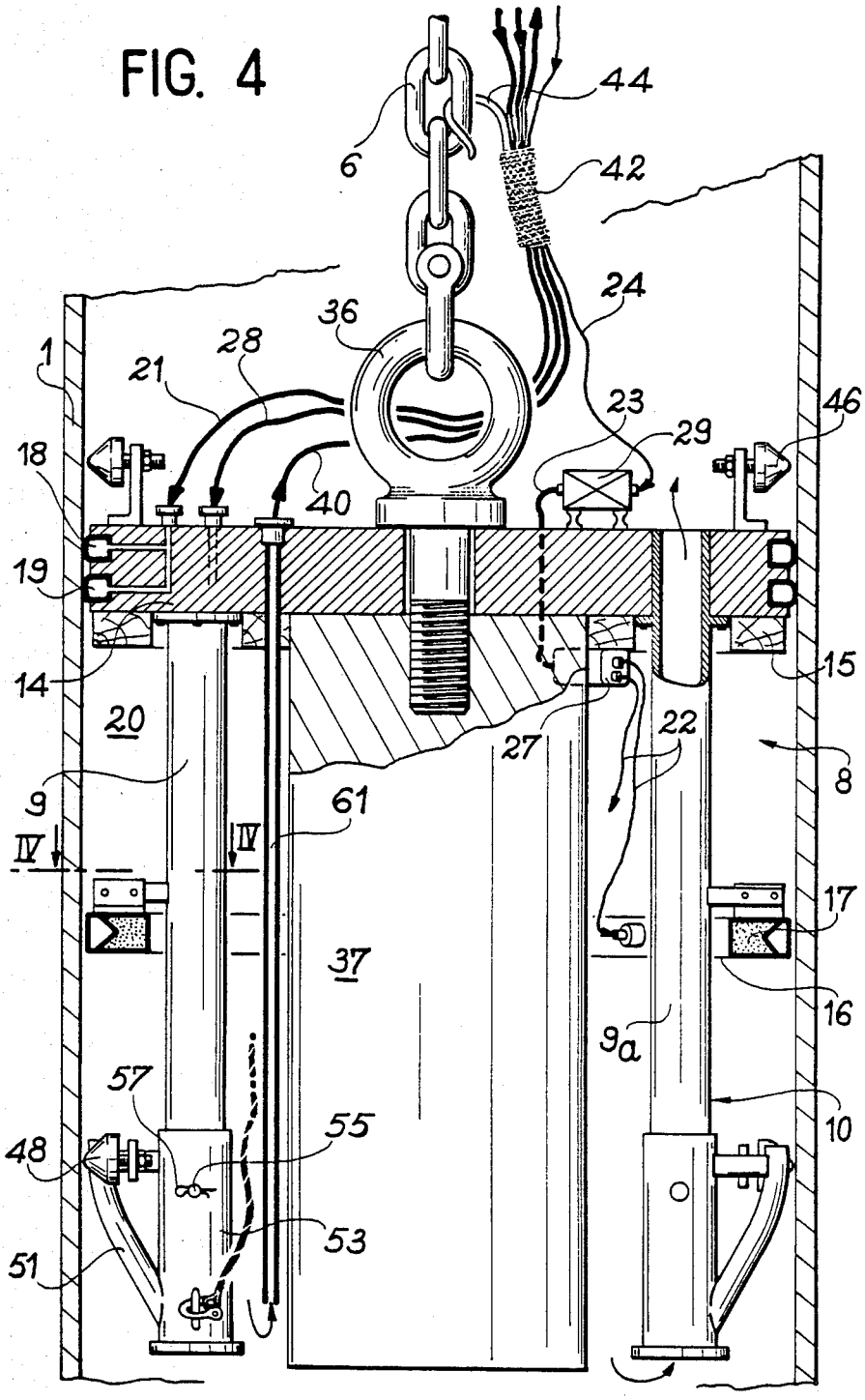
FIG. 4 a larger scale view similar to FIGS. 2 and 3 illustrating a third version of the apparatus according to the invention.

The construction of the tube-cutter can be gathered from FIGS. 2 to 4. FIG. 2 illustrates a first version in which it is possible to see the lower chassis 10, separated from the upper chassis 12 by the shield 14. Two inflatable O-rings 18, 19, which are supplied with compressed air by a pipe 21, ensure the seal between shield 14 and the inner wall of tube 1. Guides such as 11 and 13, mounted on chassis 10 and 12 respectively, ensure the centering of the assembly during the lowering within the tube. The pyrotechnic charge 17, mounted on its support 16, is supplied with a certain number of detonating cords 22, the latter being connected to a firing system mounted on platform 2 by means of a firing line 24. The pyrotechnic charge 17 is a detonating cord with a hollow charge, whilst the detonating cords 22 can have a random shape, because their function is solely to transmit the detonation to charge 17. The fitting of the firing means will be described hereinafter relative to FIG. 4.

In order to produce an air pocket below shield 14, an opening 26 is provided in the latter, to make it possible to blow in compressed air by means of a pipe 28. In order to maintain the air pocket height at a constant value, a cylindrical tube 30, called a bubble tube hereinafter, is provided and which is mounted on the shield and extends vertically below the latter over a length equal to the height of the air pocket. Thus, as compressed air is blown through the supply pipe 28, the water is progressively delivered and the level thereof below the shield descends until it is level with the lower end 31 of tube 30. At this time, the air rises through the pipe and escapes in the form of bubbles in the liquid mass above shield 14. These bubbles are visible in the upper part of the tube from the platform and their presence indicates that the air pocket has reached the desired height.

In order to facilitate the lowering of the tube-cutter according to the invention into the tube to be cut, as well as its equilibrium in the desired position when the air pocket has been formed; a member having a considerable weight is mounted on the apparatus as ballast. It is the presence of this ballast which makes it possible to lower the apparatus to considerable depths, of approximately 40 meters and more. In the case of FIG. 2, the ballast is in the form of a large thickness cylindrical tube 32, mounted above shield 14 and disposed in such a way that the bubbles escaping from the bubble tube 30 pass through the cylindrical member 32.

FIG. 3 shows a second variant, similar to that of FIG. 2, with lower chassis 10 and upper chassis 12 separated by shield 14, which is itself equipped with inflatable joints or O-rings 18, 19, the latter being supplied by pipe 21. It is also possible to see charge 17 mounted on support 16, which is itself fixed to the lower chassis 10, as well as the supply pipe 28 used for blowing compressed air below shield 14 in order to produce the air pocket. However, in this version, the small diameter bubble tube 30 is replaced by a cylindrical skirt 34, which also extends below shield 14 over a distance equal to the height of the air pocket. However, it is a large diameter skirt, which has a double advantage. Firstly, the presence of skirt 34 limits the volume of the air pocket to be formed, which is particularly advantageous when operating at great depths, because the air must be injected under high pressure for forming said pocket. Secondly, it acts as a member having a considerable weight and itself constitutes ballast. This obviates the presence of member 32 in FIG. 2, but the operating principle remains the same.

The larger-scale view of FIG. 4 illustrates a third version of this apparatus, in which the upper chassis has been eliminated. Thus, there is only a lower chassis 10, surmounted by shield 14, equipped with inflatable O-rings 18, 19, supplied by pipe 21. In this version, shield 14 only has a diaphragm function and can advantageously be made from wood.

It is also possible to see the pipe 28 for supplying compressed air for producing the air pocket below the shield. In this version, chassis 10 is formed by hollow tubes arranged vertically and whose upper end is fixed to shield 14, whilst the bubble tube is formed in one of the feet 9 of the chassis. It is possible to see that tube 9*a*, to the right of the drawing, has its lower end open and that it traverses shield 14 in its upper part.

The fact that the air passes out again on the surface of the water indicates that the air pocket has been formed and has the desired height. Thus, the compressor used for supplying pipe 28 must remain open permanently, in order to compensate any possible leaks. In redundancy, a control pipe 40, connected to platform 10 and extended by a thin tube or stick 61 traversing shield 14, accurately confirms the low level of the air pocket. Thus, the observation of bubbles from the platform is not always convenient and does not constitute a precise method, whereas through the upper end of pipe 40 being located on the platform, it is possible to see the discharge of air at this level. As a function of the volume provided by the air pocket, holes made in feet 9 at the corresponding level make it possible to calibrate the latter.

In this version, there is no upper chassis and the assembly is manipulated with the aid of a chain 6, via a ring 36 placed above shield 14 and which is screwed into a member 37 located below the latter, member 37 serving as ballast. The latter is a solid cylindrical member which, in this version also, has dimensions also making it possible to limit the volume of the air pocket. It is also possible to see charge 17 mounted on its support 16 and connected to the detonating cord 22, whilst the firing line 24 connects the assembly to the outside.

The compressed air pipes 21, 28, the control pipe 40 and the firing line 24 are joined at intervals by attachments 42, whilst hooks such as 44 make it possible to fix them to chain 6. The object of this arrangement is to maintain these elements as close as possible to chain 6 and parallel to the latter, in order to prevent incidents which could lead to serious deteriorating to the compressed air pipes or to the firing line 24.

FIG. 4 also shows that the apparatus is equipped with guidance means, constituted by stops or abutments such as 46, mounted above shield 14 and stops or abutments 48 positioned in the lower part of chassis 10.

It is also possible to see that the priming detonating cords 22 are connected to a master cord 23 by means of a synchronization box 27, the latter being positioned below shield 14 and separated therefrom by a wooden protection plate 15. The master cord 23 is connected to the firing line 24 by an initiation block 29, mounted in the upper part of shield 14.

Figure 6:
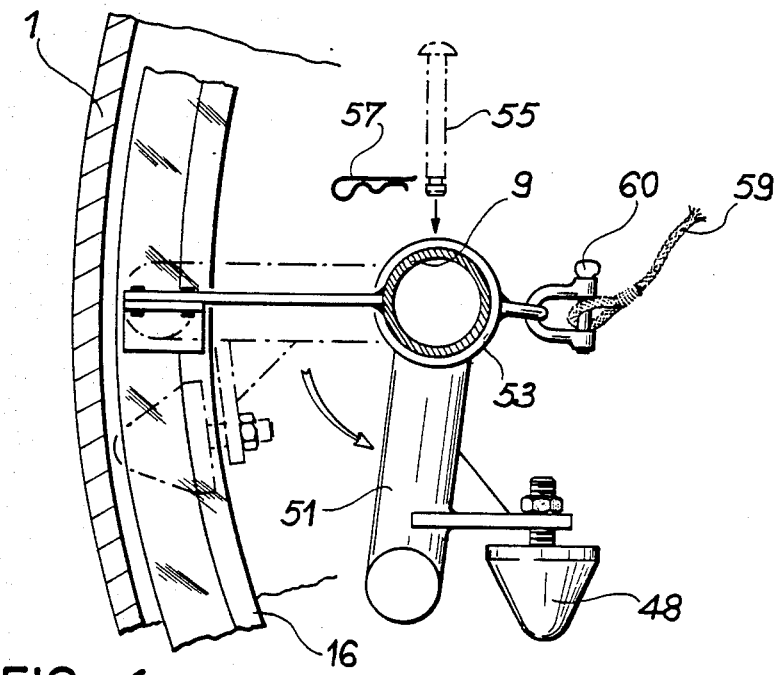
FIG. 6 a diagrammatic sectional view along line IV—IV of FIG. 4.
Figure 5:
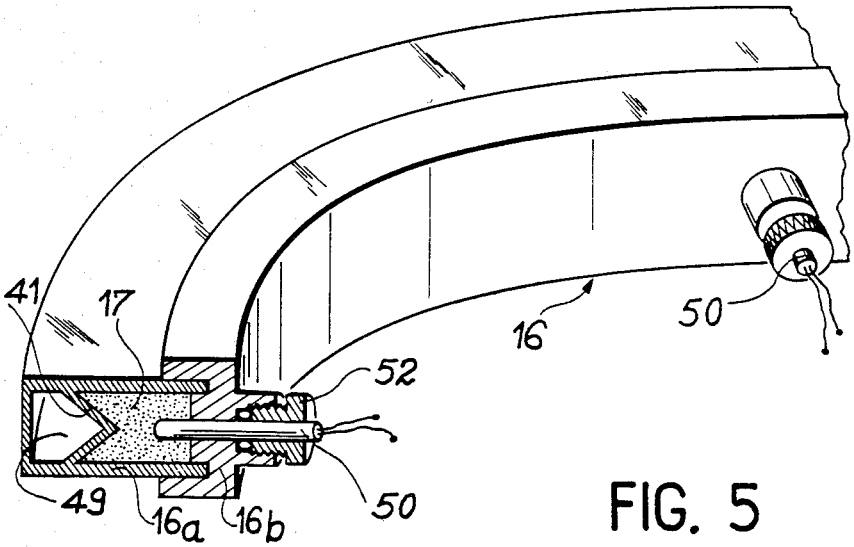
FIG. 5 a diagrammatic perspective view showing how the pyrotechnic charge is placed on its support.

FIG. 5 shows in a greater detail how charge 17 is mounted on its support 16. It is possible to see that the latter is constituted by an outer metal envelope 16*a* containing the actual charge 17 and embedded in a circular rubber member 16*b*. Within envelope 16*a*, a wall 41 separates charge 17 from a hollow chamber 49 in order to obtain a detonating cord with a hollow charge. Charge 17 is placed in a continuous manner on the periphery of support 16, which makes it possible to completely cut the tube along a cross-section thereof. Moreover, the apparatus has a very high operating reliability because, if the geometry of the assembly is carefully checked, the clearance between envelopes 49 and the wall of the tube (i.e. between the explosive and the tube wall) is extremely small (a few millimeters) and in particular it is the same throughout, which is indispensable for the satisfactory functioning of a hollow charge. Tests have shown that an explosive gelatin weight of 9 kg would be sufficient for cutting tubes with a diameter of 1.50 to 2 meters and a thickness of approximately 25 mm. As can be seen in FIG. 6, support 16 is shaped like a torus, whose external diameter is slightly smaller than the internal diameter of the tube to be cut. At intervals, detonators 50 are provided and they are maintained in support 16 by means of a stuffing box 52 in order to initiate the charge, the number of detonators being a function of the dimensions of the tube to be cut.

In view of the fact that the charge 17 mounted on its support 16 must be fixed to the lower chassis 10 of the tube-cutter, following the introduction by the lower part of the latter, a particular arrangement has been provided for the guidance stops 48 located in the lower part of chassis 10. This arrangement can be gathered from FIG. 4, as well as the plan view of FIG. 6. At the foot of each tube 9 forming the lower chassis, there is a cylindrical member 53 able to pivot around tube 9, the stop 48 being mounted on a support 51 integral with member 53. The latter is fixed to tube 9 by means of a pin 55, secured by a clip 57.

The tube-cutter is installed on the platform, prior to the introduction of the latter into the tube to be cut. Charge 17 is mounted on its support 16, before being introduced along tubes 9 and around the latter up to its normal operating position. In order to permit the passage of support 16, pin 55 and clip 57 are removed, in order to pivot cylindrical member 53 up to the position shown in continuous line form in FIG. 6. Support 16 with charge 17 is then introduced along tubes 9 up to its normal position shown in FIG. 4. Member 53 is then pivoted in order that the assembly constituted by the latter, the support 51 and the stop 48 returns to the normal position represented in mixed line form in FIG. 6. A sling 59, whereof one end is connected to member 53 by a coupling link 60, has its other end fixed to shield 14 in order that it is possible to raise the lower chassis after the explosion, should it be disengaged from the shield.

A cutting operation using the processor according to the invention makes place in the following way. The tube-cutter is firstly entirely mounted on the platform, with the charge fixed to its support and then the latter is moved along the lower chassis in the manner indicated hereinbefore. The detonating cords and the firing means are placed in the latter, just prior to the lowering of the assembly into the tube. The satisfactory operation of the assembly is checked and this is followed by the start of the lowering of the assembly into the tube. During the lowering operation, the compressed air pipes and the firing line are attached to chain 6 by means of hooks 44, as illustrated in FIG. 4.

Once the desired depth has been reached, the O-rings 18, 19 of shield 14 are inflated and come into contact with tube 1 to provide the necessary seal. Compressed air is then passed through pipe 28 to form the air pocket. When the latter reaches the desired height (discharge of air in the upper part of pipe 40 and/or bubbling on the free surface of the water), firing takes place, whilst respecting the well known safety regulations, which will not be defined here. Following the explosion, the apparatus is raised and the tube discharged.

The process and apparatus according to the invention offer numerous advantages, because the apparatus is easy to mount on the platform and its installation in the tube, even at a very great depth, does not require the use of divers. The operation takes approximately 2½ hours. Moreover, the fact that the pyrotechnic charge 16 is in air and not in water means that a reasonably dimensioned charge is available and all its energy is converted into cutting action. Moreover, a considerable operational security and safety is obtained, due to the fact that the cutting detonating cord is positioned in a continuous manner on its support, with a very small, constant clearance between the charge and the inner wall of the tube. It is thus possible to cut very large tubes (diameter approximately 2 meters and thickness 30 mm), whilst the presence of the ballast makes it possible to operate at depths greater than 40 meters.

A very considerable operating safety is indispensable, particularly in the case of dismantling offshore installations. Thus, cutting must be total as from the first firing because, in the case of a partial cutting, it is no longer possible to subsequently recreate an air pocket at the same point, because the compressed air escapes from the tube. It is for this reason that the detonating cord and its support must be very accurately manufactured (the clearance between the cord and the inner wall of the tube being very small and constant), but this implies that the apparatus remains perfectly vertical throughout its introduction into the tube. This result is obtained by means of the member acting as ballast, the guides such as 11 (FIG. 2) and 51 (FIG. 4) and the stops for abutments such as 46 and 48 equipping the apparatus.

However, it is still possible to carry out a cutting operation entirely in water, but for identical tube dimensions, it requires a more powerful pyrotechnic charge, because the thickness of the water corresponding to the operational clearance between the support 16 and the tube 1 absorbs a by no means negligible quantity of energy. In this case, there is a greater deformation of the tube.

Among the various versions of the tube-cutter defined hereinbefore, the first two versions permit a partial recovery of equipment. For economic reasons, the third is considered as "disposable", with the exception of the ballast which is reused. The latter constitutes the preferred embodiment of the apparatus according to the invention.

Moreover, the maximum efficiency of the apparatus is dependent on the following:

cutting carried out in an air pocket with a minimum volume and located around the charge.

the perfect geometrical quality of the hollow chamber 49 produced in support 16, and precise centering of the tube-cutter in the tube, to the right of the cutting plane.

Obviously, the invention is not limited to the exemplified embodiments described hereinbefore and numerous variants can be made thereto without passing beyond the scope of the invention, particularly in connection with the diameter of the tubes and the cutting depth.

What is claimed is:

1. An apparatus for cutting a submerged tube with the aid of a pyrotechnic charge which is introduced into the tube, the latter having an inner wall and an outer wall, comprising: at least one chassis having an upper end and a lower end, a support for the pyrotechnic charge mounted on the chassis, a shield mounted on the upper end of the chassis, means for forming an air pocket below the shield when the apparatus is placed within the tube, and means for checking the height of the air pocket, a member having a considerable weight serving as ballast, the pyrotechnic charge being a detonating cord with a hollow charge placed in a continuous manner on its support, the shape and dimensions of the cord and the support being such that the clearance between the cord and the inner wall of the tube is of a minimum nature and is the same at any point on the cord, said means for checking the height of the air pocket comprising a pipe extending vertically below the shield over a height equal to that of the air pocket and connected to the surface by a control pipe.

2. An apparatus according to claim 1, wherein the ballast is a high thickness tubular member, placed above the shield.

3. An apparatus according to claim 1, wherein the ballast is a cylindrical skirt placed below the shield.

4. An apparatus according to claim 1, wherein the ballast is a solid cylindrical member placed below the shield.

5. An apparatus according to claim 1, wherein the chassis comprises at least one foot having an upper end and a lower end, the upper end of the foot, being fixed to the shield, the foot being a hollow cylindrical tube serving as a means for controlling the height of the air pocket.

6. An apparatus according to claim 1, wherein the chassis has at least one foot with an upper end and a lower end, the upper end of the foot being fixed to the shield and incorporating at least one guidance abutment or stop mounted on a cylindrical sleeve pivotably fitted to the lower end of the foot.

7. An apparatus for cutting a submerged tube with the aid of a pyrotechnic charge which is introduced into the tube, the latter having an inner wall and an outer wall, comprising: at least one chassis having an upper end and a lower end, a support for the pyrotechnic charge mounted on the chassis, a shield mounted on the upper end of the chassis, means for forming a seal between the shield and the inner wall of the tube, means for forming an air pocket below the shield when the apparatus is placed within the tube, and means for checking the height of the air pocket, a member having a considerable weight serving as ballast, the pyrotechnic charge being a detonating cord with a hollow charge placed in a continuous manner on its support, the shape and dimensions of the cord and the support being such that the clearance between the cord and the inner wall of the tube is of a minimum nature and is the same at any point on the cord, said means for checking the height of the air pocket comprising a pipe extending vertically below the shield over a height equal to that of the air pocket.

8. An apparatus according to claim 7, wherein the ballast is a high thickness tubular member, placed above the shield.

9. An apparatus according to claim 7, wherein the ballast is a cylindrical skirt placed below the shield.

10. An apparatus according to claim 7, wherein the ballast is a solid cylindrical member placed below the shield.

11. An apparatus according to claim 7, wherein the chassis comprises at least one foot having an upper end and a lower end, the upper end of the foot being fixed to the shield, the foot being a hollow cylindrical tube serving as a means for controlling the height of the air pocket.

12. An apparatus according to claim 7, wherein the chassis has at least one foot with an upper end and a lower end, the upper end of the foot being fixed to the shield and incorporating at least one guidance abutment or stop mounted on a cylindrical sleeve pivotably fitted to the lower end of the foot.

* * * * *